United States Patent [19]

Streich et al.

[11] Patent Number: 4,956,624

[45] Date of Patent: Sep. 11, 1990

[54] AUXILIARY SWITCH ATTACHMENT BLOCK

[75] Inventors: Georg Streich, Amberg; Guenter Gnahn, Sulzbach-Rosenberg, both of Fed. Rep. of Germany

[73] Assignee: Siemens Aktiengesellschaft, Berlin & Munich, Fed. Rep. of Germany

[21] Appl. No.: 344,106

[22] Filed: Apr. 27, 1989

[30] Foreign Application Priority Data

May 3, 1988 [DE] Fed. Rep. of Germany ... 8805878[U]

[51] Int. Cl.[5] ..... H01H 67/02

[52] U.S. Cl. ..... 335/32; 335/202

[58] Field of Search ..... 335/132, 133, 134, 202

[56] References Cited

U.S. PATENT DOCUMENTS 3,188,405 6/1965 Scheib, Jr. ..... 335/126

FOREIGN PATENT DOCUMENTS 0045683 10/1982 European Pat. Off. .

1909460 3/1970 Fed. Rep. of Germany .

8223377.2 11/1982 Fed. Rep. of Germany .

*Primary Examiner*—Leo P. Picard

*Assistant Examiner*—Lincoln Donovan

*Attorney, Agent, or Firm*—Kenyon & Kenyon

[57] ABSTRACT

An auxiliary switch attachment block for electromagnetic switchgear having a hammer head shaped, positive engagement coupling between the contact bridge carrier of the electromagnetic switchgear and the auxiliary switch attachment block in which the subsurfaces of the free legs of the contact bridge carrier to be coupled, which flank the hammer handle, extend at an angle away from the handle beginning at the head, so that a tilting motion of the hammer head shaped formation relative to the other contact bridge carrier is possible.

16 Claims, 2 Drawing Sheets

AUXILIARY SWITCH ATTACHMENT BLOCK

BACKGROUND OF THE INVENTION

The present invention relates to an auxiliary switch attachment block for electromagnetic switchgear with a hammer head shaped, positive-engagement coupling between the contact bridge carrier of the electromagnetic switchgear and the contact bridge carrier of the auxiliary switch in general, and more particularly an improved auxiliary switch attachment block of this type.

In a known arrangement of the above-mentioned type (European Patent Application No. EPO 045 683), the positive-engagement coupling extends over the entire hammer head. The contact bridge carriers of the electromagnetic switchgear and of the auxiliary switch are guided in separate housings. Because of these factors, it is not possible to preclude the jamming of the contact bridge carriers against each other and influencing of the drive of the electromagnetic switchgear with respect to friction that must be avoided.

Thus, there is a need for an auxiliary switch attachment block of the above-mentioned type which is improved with respect to adaptation and stability.

SUMMARY OF THE INVENTION

This need is fulfilled by the present invention through having the subsurfaces, i.e., the free legs, of the contact bridge carrier of the auxiliary switch extend at an angle away from the hammer handle of the hammer head, starting at the head. This arrangement of the present invention allows a tilting motion between the two contact carriers so that jamming is prevented. While the stability remains the same, the contact surface of the joint can be increased and made more secure by forming the support areas of the hammer head adjacent to the handle in the manner of a claw and adapting the corresponding contact surfaces of the auxiliary switch contact bridge carrier to be coupled to it to this inclination. The tilting angle can be increased further if the handle of the hammer is additionally tapered inwardly continuously in a direction toward the hammer head. In order to largely eliminate material stresses at the junction point of the hammer head and the handle, it is additionally of advantage if the hammer head is continuously tapered inwardly in a direction away from the hammer handle. In order to avoid, in spite of the possible tilting motion, a loose stress of the contact bridge carrier when changing from tensil into compression stress and vice versa, it is advantageous if, on the side of the head opening opposite the free legs of the contact bridge carrier to be coupled, a centrally arranged support surface is provided. Furthermore, a simple fabrication of the joint in the assembly can be achieved if the lead-in edges for the hammer head at the contact bridge carrier to be coupled are beveled.

DETAILED DESCRIPTION

Figure 1A:
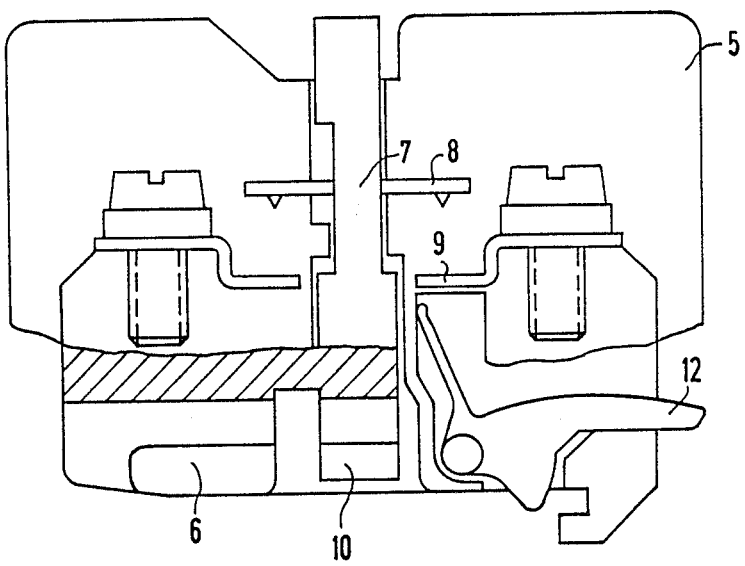
FIG. 1A is a view of the auxiliary switch attachment block of the present invention, partially in section, in a position not placed on the switch gear.
Figure 1B:
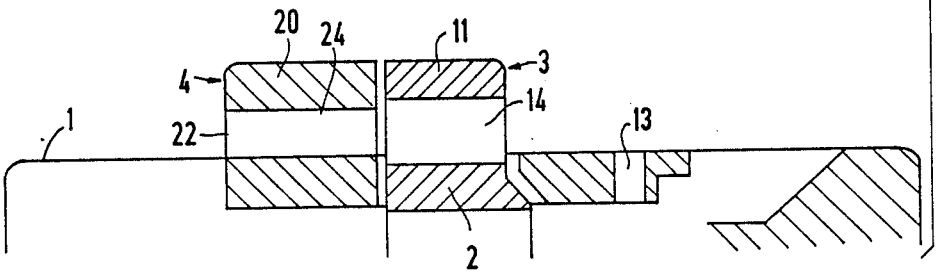
FIG. 1B illustrates the top of the switch gear onto which the attachment block of FIG. 1A is to be placed.

In FIG. 1B, the upper part of an electromagnetic switchgear 1 is shown, partially in section, on the top side of which a contact bridge carrier 2 protrudes with a formation 3 including a hammer head 11 on a hammer handle 14. Beside this hammer head shaped formation 3 of the contact bridge carrier 2, a further hammer head shaped formation 4 with hammer head 20 and handle 22 is formed on the housing of the electromagnetic switchgear 1 onto which the housing of the auxiliary switch attachment block 5 is fastened. Fastening of the two housings is accomplished through the use of ridges 6 formed at the wall of the housing. The ridges engage beneath the undersurface 24 of the hammer head 20.

The contact bridge carrier of the auxiliary switch attachment block 5 is designated as 7. It receives a contact bridge 8 which cooperates with fixed contact parts 9. A formation including ridges or free legs 10 at the bottom of the contact bridge carrier 7 of the auxiliary switch attachment block is provided to surround and engage the hammer head 11 of the hammer head shaped formation 3 of the contact bridge carrier 2, as shown in FIGS. 2 and 4.

In order to establish the coupling in which ridges 6 engage the hammer head 4 and the ridges 10 engage the hammer head 11, the auxiliary switch attachment block 5 of FIG. 1A is shifted from the right to the left, relative to the electromagnetic switchgear 1 of FIG. 1B in such a manner that first the ridges 6 are shifted past the hammer head shaped formation 3, into the region of the hammer head shaped formation 4. The ridges 10 then come into engagement with the hammer head shaped formation 3 so that the position seen in FIG. 2 and FIG. 3 is obtained. For detenting the auxiliary switch attachment block with the electromagnetic switchgear in the inserted condition, a detent lever 12 which engages a recess 13 in the surface of the electromagnetic switchgear 1 is provided.

Figure 4:
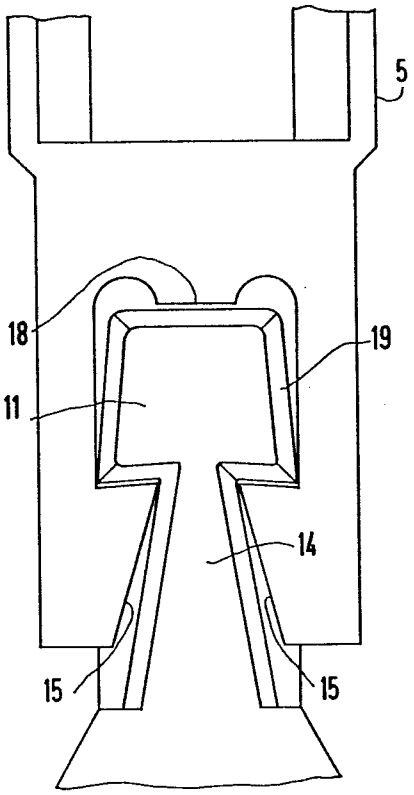
FIG. 4 illustrates another embodiment of the coupling according to FIGS. 2 and 3.
Figure 2:
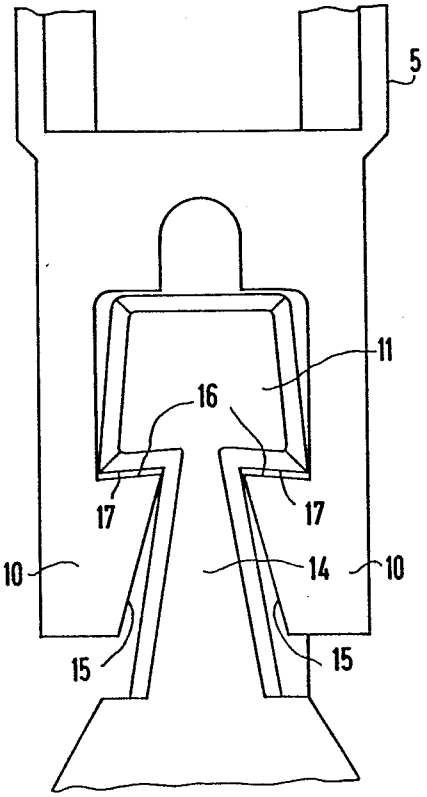
FIGS. 2 and 3 are a front view and side view, respectively, of the positive-engagement coupling of the switchgear of FIG. 1B with the attachment block of FIG. 1A.
Figure 3:
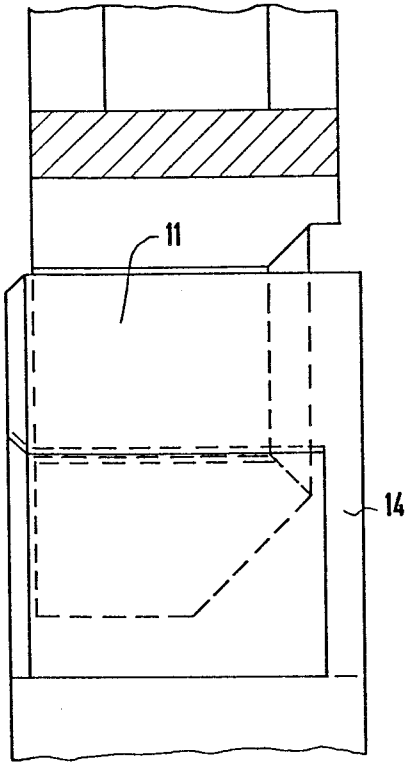

The subsurfaces 15 of the ridges or free legs 10 flanking a hammer handle 14 on which hammer head 11 is supported, extend at an angle away from the handle, starting at the hammer head 11, as is shown in FIGS. 2 and 4. The hammer handle 14 itself is tapered inwardly continuously in a direction toward the hammer head 11. Contact surfaces 16 of the strip shaped formation 10 cooperate with the contact surfaces 17 on the underside of the hammer head 11. These support surfaces 16 are inclined in the manner of a claw, as are the corresponding contact surfaces 17 of the hammer head 11. The hammer head 11 is furthermore tapered in a direction pointing away from the hammer handle so that tilting of the hammer head shaped formation relative to the contact bridge carrier 7 is possible. To facilitate the tilting motion, a support 18 centrally formed in the insertion opening as shown in FIG. 4 is of advantage. As FIGS. 2 and 4 show distinctly, the insertion edges of the hammer head itself as well as of the handle are beveled. These surfaces are designated as 19. In the same manner, the contact surfaces 16 of the ridges 10 are also beveled to simplify the insertion.

What is claimed is:

1. In an auxiliary switch attachment block for electromagnetic switchgear including a hammer head shaped, positive engagement coupling between the contact bridge carriers of the electromagnetic switchgear and the auxiliary switch, the hammer head supported on a hammer handle and the contact bridge carrier having free legs with subsurfaces below a point of positive engagement of coupling with the hammer head, the improvement comprising the subsurfaces of the free legs of the contact bridge carrier flanking the hammer handle extending away from the handle at an angle, starting at the hammer head.

2. The improvement according to claim 1, wherein the hammer head has support surfaces adjacent to the handle and wherein said support surfaces extend inclined in the manner of a claw and wherein the contact bridge carrier of the switch attachment block has corresponding contact surfaces adapted to this inclination.

3. The improvement according to claim 2 wherein said hammer handle is continuously tapered inwardly in a direction toward the hammer head.

4. The improvement according to claim 3 wherein the hammer head is continuously tapered inwardly in a direction pointing away from the hammer handle.

5. The improvement according to claim 4 and further including a centrally arranged support surface on the side of the head opening in said auxiliary switch contact bridge holder opposite said corresponding contact surfaces of said contact bridge carrier.

6. The improvement according to claim 5 wherein said hammer head has lead-in edges beveled at the contact bridge carrier.

7. The improvement according to claim 1 wherein said hammer handle is continuously tapered inwardly in a direction toward the hammer head.

8. The improvement according to claim 7 wherein the hammer head is continuously tapered inwardly in a direction pointing away from the hammer handle.

9. The improvement according to claim 8 and further including a centrally arranged support surface on the side of the head opening in said auxiliary switch contact bridge holder opposite said corresponding contact surfaces of said contact bridge carrier.

10. The improvement according to claim 9 wherein said hammer head has lead-in edges beveled at the contact bridge carrier.

11. The improvement according to claim 1 wherein the hammer head is continuously tapered inwardly in a direction pointing away from the hammer handle.

12. The improvement according to claim 11 and further including a centrally arranged support surface on the side of the head opening in said auxiliary switch contact bridge holder opposite said corresponding contact surfaces of said contact bridge carrier.

13. The improvement according to claim 12 wherein said hammer head has lead-in edges beveled at the contact bridge carrier.

14. The improvement according to claim 1 and further including a centrally arranged support surface on the side of the head opening in said auxiliary switch contact bridge holder opposite said corresponding contact surfaces of said contact bridge carrier.

15. The improvement according to claim 14 wherein said hammer head has lead-in edges beveled at the contact bridge carrier.

16. The improvement according to claim 1 wherein said hammer head has lead-in edges beveled at the contact bridge carrier.

* * * * *